US010941577B1

(12) United States Patent
Bennett et al.

(10) Patent No.: US 10,941,577 B1
(45) Date of Patent: Mar. 9, 2021

(54) ANTI-THEFT APPARATUS AND SYSTEMS AND METHODS FOR USING SAME

(71) Applicant: CH3 SOLUTIONS, LLC, Dalton, GA (US)

(72) Inventors: Ron Bennett, Dalton, GA (US); Warren Lusk, Dalton, GA (US); Josh Pressnell, Dalton, GA (US)

(73) Assignee: CH3 Solutions, LLC, Dalton, GA (US)

( * ) Notice: Subject to any disclaimer, the term of this patent is extended or adjusted under 35 U.S.C. 154(b) by 0 days.

(21) Appl. No.: 16/597,293

(22) Filed: Oct. 9, 2019

(51) Int. Cl.
*E04F 15/02* (2006.01)
*E01C 13/04* (2006.01)
*E01C 5/00* (2006.01)

(52) U.S. Cl.
CPC ..... *E04F 15/02005* (2013.01); *E01C 5/005* (2013.01); *E01C 13/04* (2013.01); *E04F 2201/0517* (2013.01)

(58) Field of Classification Search
CPC ..... E04F 13/0876; E04F 15/02005; E04F 2201/0517; E04F 2201/0547; E04F 2201/0505; E04B 1/6141; E01C 5/005; E01C 13/04
See application file for complete search history.

(56) References Cited

U.S. PATENT DOCUMENTS 3,438,312 A 4/1969 Becker et al.
4,167,599 A 9/1979 Nissinen
4,367,615 A 1/1983 Feldman
4,436,779 A 3/1984 Menconi et al.
4,468,910 A 9/1984 Morrison
4,584,221 A 4/1986 Kung
4,930,286 A 6/1990 Kotler
5,009,045 A 4/1991 Yoder
5,070,662 A * 12/1991 Niese ..... E04B 1/6141 403/362
5,076,534 A 12/1991 Adam
5,323,575 A 6/1994 Yeh
5,509,244 A 4/1996 Bentzon
5,628,160 A * 5/1997 Kung ..... E01O 5/20 52/591.1
5,950,378 A * 9/1999 Council ..... E01C 13/045 52/177
9,206,559 B2 * 12/2015 Bach ..... E01C 9/086
9,809,982 B2 * 11/2017 Randjelovic ..... E04F 15/02038
9,919,835 B2 * 3/2018 Brisendine ..... B65D 19/38
2002/0189176 A1 * 12/2002 Stegner ..... E01O 5/20 52/177
2004/0005430 A1 * 1/2004 Rogers ..... F16B 5/0635 428/44

(Continued)

FOREIGN PATENT DOCUMENTS

CH 649798 6/1985

*Primary Examiner* — Christine T Cajilig
(74) *Attorney, Agent, or Firm* — Avant Law Group, LLC

(57) ABSTRACT

An anti-theft tile system includes a first tile having a female interlock mechanism, a second tile having a male interlock mechanism; and an anti-theft apparatus. The female interlock mechanism engages with the male interlock mechanism to form a point of connection to temporarily secure the first tile to the second tile. The anti-theft apparatus engages with the male and female interlock mechanisms at the point of connection to prevent separation of the first and second tiles.

13 Claims, 5 Drawing Sheets

(56) References Cited

U.S. PATENT DOCUMENTS

| | | | | |
|---|---|---|---|---|
| 2006/0165484 | A1* | 7/2006 | Walker | F16B 12/24 403/403 |
| 2009/0077918 | A1* | 3/2009 | Ban | E01C 5/005 52/588.1 |
| 2015/0010350 | A1* | 1/2015 | Emanuel | B29C 70/523 403/364 |
| 2019/0211514 | A1* | 7/2019 | Jones | H02G 9/025 |

* cited by examiner

ANTI-THEFT APPARATUS AND SYSTEMS AND METHODS FOR USING SAME

FIELD OF THE INVENTION

The invention relates to anti-theft apparatus and systems and methods for utilizing anti-theft apparatus in interlocking tile assemblies.

BACKGROUND

Interlocking tiles are utilized as surfaces and sub-surfaces in many different industries. Generally, the interlocking tiles are easily installed by mating the interlocking components of respective tiles and placing the tiles in the desired location. Unfortunately, while the interlocking tiles are easily installed, they can also be readily uninstalled simply by separating one interlocking tile from the surrounding tiles, making them an easy target for thieves.

SUMMARY

The following presents a simplified summary of the invention in order to provide a basic understanding of some aspects of the invention. This summary is not an extensive overview of the invention. It is not intended to identify critical elements of the invention or to delineate the scope of the invention. Its sole purpose is to present some concepts of the invention in a simplified form as a prelude to the more detailed description that is presented elsewhere herein.

In one embodiment, an anti-theft tile system includes a first tile having a female interlock mechanism, a second tile having a male interlock mechanism; and an anti-theft apparatus. The female interlock mechanism engages with the male interlock mechanism to form a point of connection to temporarily secure the first tile to the second tile. The anti-theft apparatus engages with the male and female interlock mechanisms at the point of connection to prevent separation of the first and second tiles.

In another embodiment, an anti-theft tile system has a plurality of interlocking tiles secured together to form a tile system. The tile system has a perimeter that is defined by a portion of the plurality of interlocking tiles. Each tile of the portion of the plurality of interlocking tiles defining the perimeter is connected to another tile of the portion of the plurality of interlocking tiles defining the perimeter at a first region of interlock. At least one anti-theft apparatus engages with each first region of interlock to prevent separation of the respective tiles.

In still another embodiment, an anti-theft tile system includes a first tile having a plurality of female interlock mechanisms, a second tile having a plurality of male interlock mechanisms, and a plurality of anti-theft apparatus. Each female interlock mechanism engages with a male interlock mechanism to form a respective point of connection for temporarily securing the first tile to the second tile. A portion of the respective points of connection receive one of the plurality of anti-theft apparatus to prevent separation of the first and second tile.

DETAILED DESCRIPTION

Figure 1:
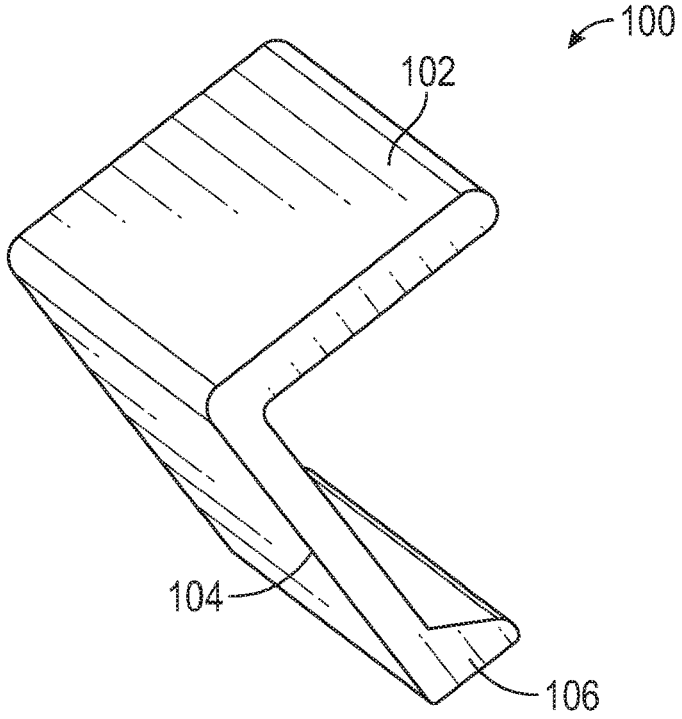
FIG. 1 is a perspective view of an anti-theft apparatus according to an embodiment of the invention.
Figure 2:
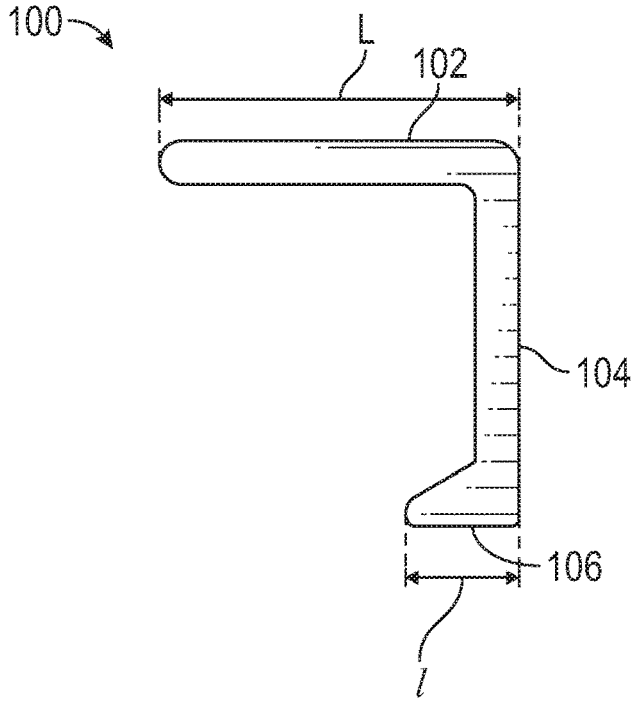
FIG. 2 is side view of an anti-theft apparatus according to an embodiment of the invention.

Provided herein are embodiments of anti-theft apparatus, and systems and methods for utilizing such anti-theft apparatus for preventing unobstructed disassembly and theft of interlocking tiles. Referring first to FIGS. 1-2, in embodiments, an anti-theft apparatus 100 is a locking mechanism having a first flange 102 and a second flange 106 extending from opposing sides of a structure 104. The first flange 102 and the second flange 106 may each extend substantially perpendicularly from the support structure 104. Preferably, the flange 102 and the flange 106 are generally parallel, although this is not necessary. The first flange 102 and the second flange 106 may each be configured to rest adjacent a respective portion of the interlocking tiles 120 and 130, as will be described in greater detail below.

In some embodiments, a length L the first flange 102 is longer than a length 1 of the second flange 106, and in some instances, the first flange 102 is significantly longer than the second flange 106. For example, the second flange 106 may be about 1-50% of the length of the first flange 102.

Figure 3:
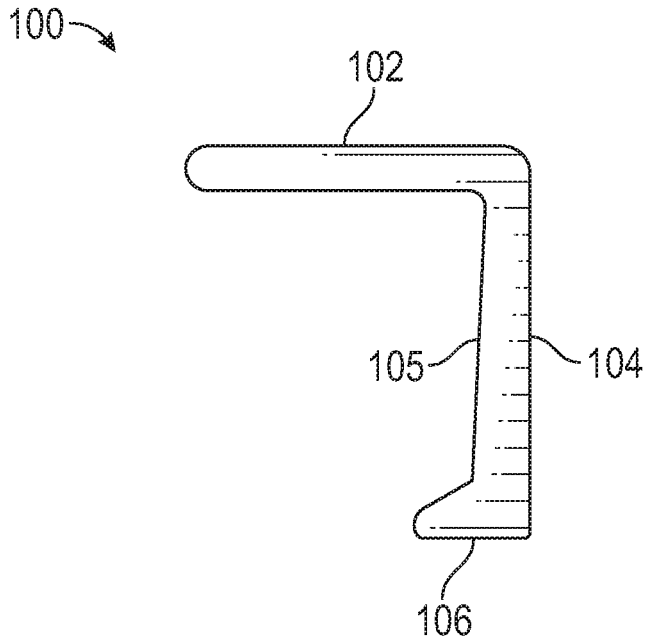
FIG. 3 is another side view of an anti-theft apparatus according to an embodiment of the invention.

Referring now to FIG. 3, in some embodiments, the structure 104 may have one or more angled surfaces 105. The angled surface 105 may be angled from about 0 to 40 degrees relative to vertical, though the angle may be greater than 40 degrees. As will be understood by those of skill in the art, the angled surface 105 may help to provide a friction fit between the locking apparatus 100 and the interlocking tiles 120 and 130 when in use to further discourage unwanted separation of the tiles 120 and 130.

U.S. Pat. No. 5,628,160, incorporated herein by reference in its entirety, describes an interlocking tile system that includes at least two interlocking tiles. Each interlocking tile has at least one female coupling and at least one male coupling. The at least one male coupling of one tile is configured to mate with the at least one female coupling of another tile. Typically, each tile has two adjacent sides having a plurality of female couplings and two adjacent sides having a plurality of male couplings. In this way, each tile can be secured to four additional tiles (i.e., one on each side). FIGS. 4-8 illustrate an exemplary interlocking tile system 115 which is substantially similar to the tile system described in U.S. Pat. No. 5,628,160 and which may receive an anti-theft apparatus 100 as described herein.

Figure 4:
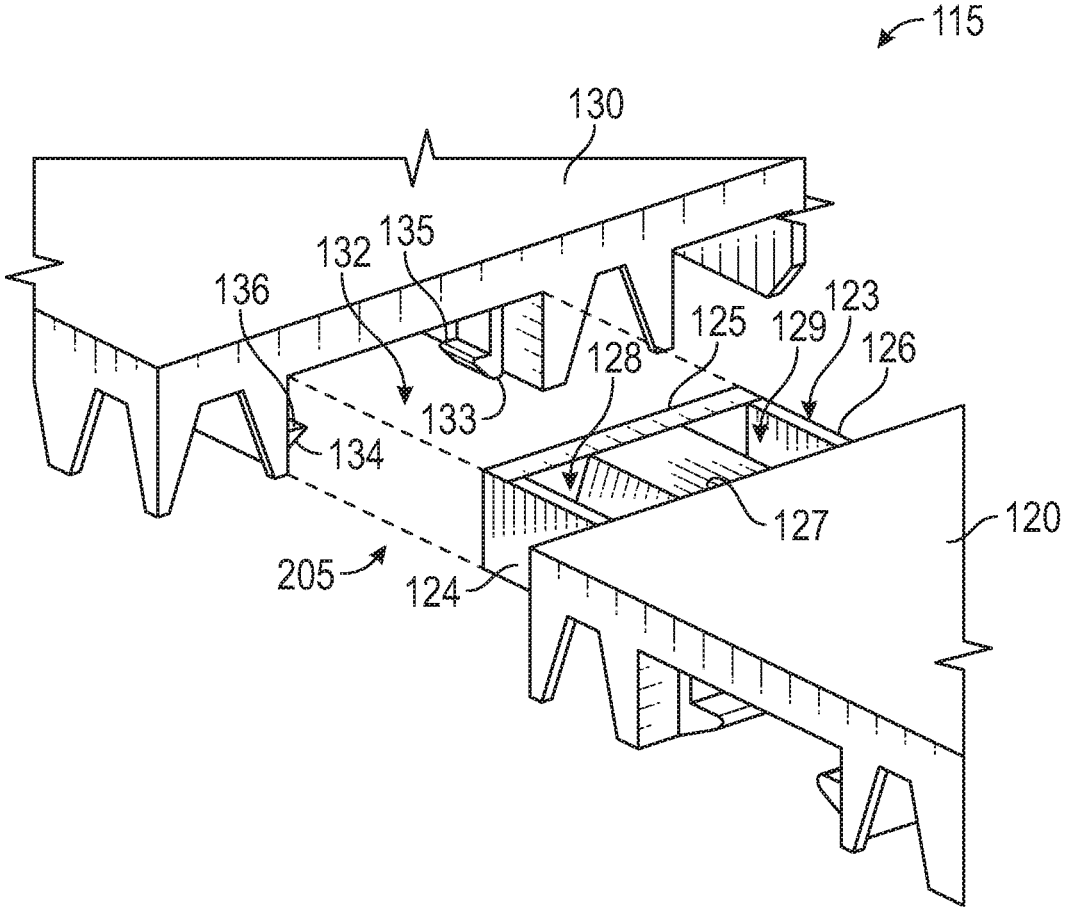
FIG. 4 is a partial perspective view of an interlocking tile system according to embodiments of the invention.

FIG. 4 shows a partial perspective view of a tile system 115 having a first with 120 having a female interlock mechanism 122 and a second tile 130 having a male interlock mechanism 132. Of course, as with the tiles in the '160 patent, each tile 120 and 130 may have one or more female interlock mechanisms and one or more male interlock mechanisms. Typically, each tile 120 and 130 will have two adjacent sides with three male interlock mechanisms 132 on each of the adjacent sides (for a total of six male interlock mechanisms) and two adjacent sides with three female interlock mechanisms 122 on each side (for a total of six female interlock mechanisms).

The male interlock mechanism 132 includes a pair of spring latches 133 and 134, each having a shoulder 135 and 136 respectively. The male interlock mechanism 132 is designed to fit closely with the female interlock mechanism 122. The female interlock mechanism 122 includes an elongated rectangular structure 123 extending from the tile 120 and defining three walls 124, 125, and 126. A central portion 127 is defined between the tile 120 and the elongate wall 125, and respective openings 128 and 129 are formed between the central portion 127 and the walls 124 and 126. To lock the tiles 120 and 130 together, the spring latches 133 and 134 are aligned with the respective openings 128 and 129, and pressed together such that the shoulders 135 and 136 engage with opposing sides of the central portion 127. A base of the central portion 127 may be wider than the gap between the respective spring latches 133 and 134, and the walls of the central portion 127 may be angled relative to vertical such that, when two tiles (e.g., tiles 120 and 130 in FIGS. 5-8) are conjoined, the spring latches 133 and 134 are temporarily deformed (e.g., forced outward) until the shoulders 135 and 136 are engaged with the central portion 127. To disconnect the tiles 120 and 130, one must simply pull apart the tiles 120 and 130 by overcoming the spring fit between the female interlock mechanism 122 and the male interlock mechanism 132.

Figure 5:
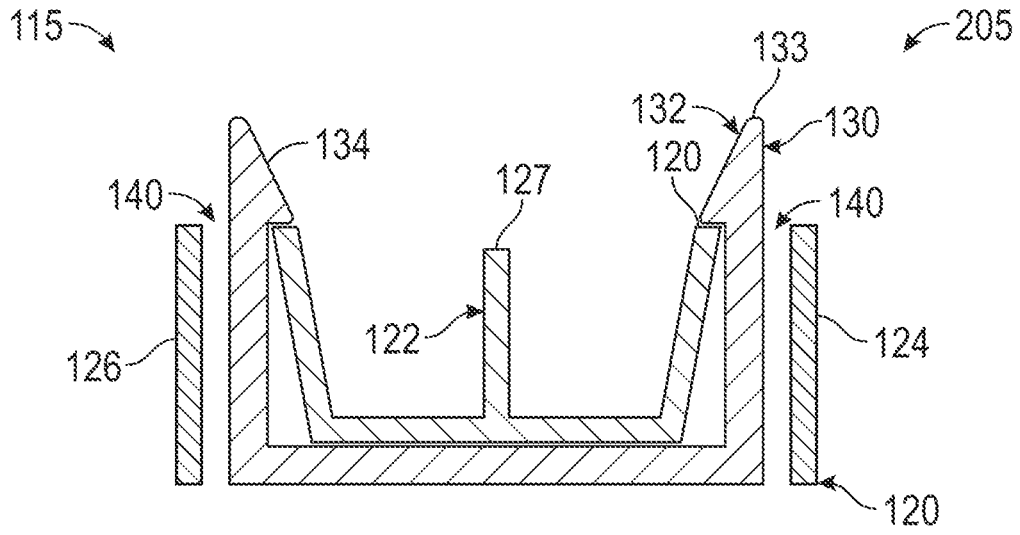
FIG. 5 is partial close-up sectional side view of a point of connection of the interlocking tile system of FIG. 4.

Referring now to FIG. 5, which shows a partial section view of a portion of the interlocking tile system 115 wherein the interlocking tiles 120 and 130 are conjoined. When the male interlock mechanism 132 is engaged with the female interlock mechanism 122 as shown in FIG. 5, there is a space 140 between the spring latch 133 and the wall 124, and between the spring latch 134 and the wall 126. This space 140 allows a user to pull apart the tiles 120 and 130 because the spring latches 133 and 134 can be forced outward so as to separate from the female interlocking mechanism 122. To prevent the ability to separate the tiles 120 and 130, the space 140 may be filled by the anti-theft apparatus 100 described herein.

Figure 6:
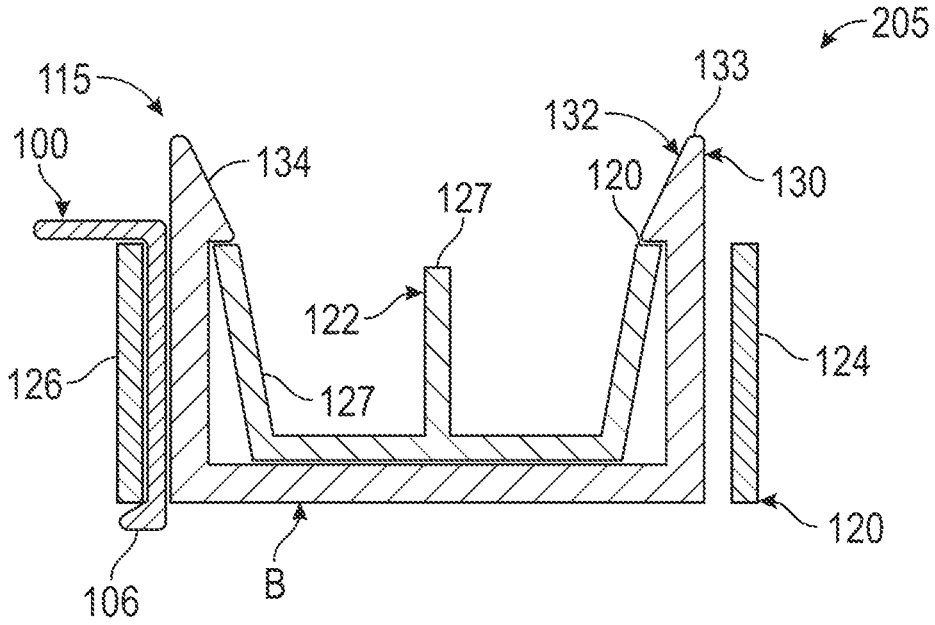
FIG. 6 is a partial close-up sectional side view of a point of connection of the interlocking tile system of FIG. 4 showing an anti-theft apparatus engaged therewith.
Figure 7:
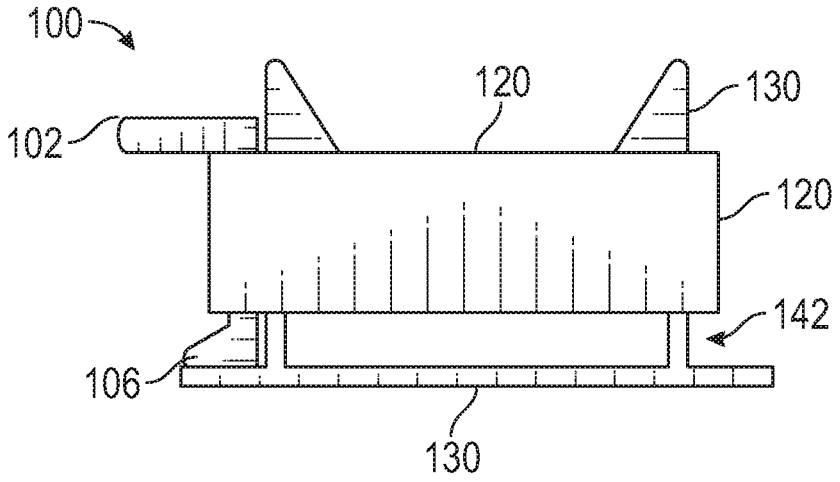
FIG. 7 is a partial side view of the point of connection of the interlocking tile system of FIG. 6.
Figure 8:
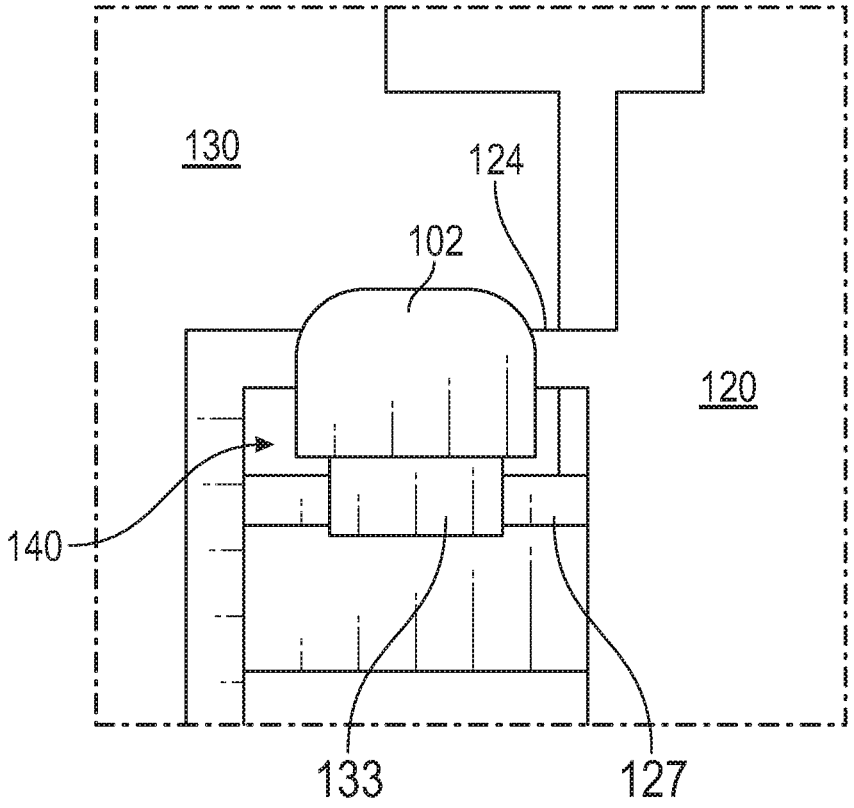
FIG. 8 is a close-up bottom view of the point of connection of the interlocking tile system of FIG. 6.

FIGS. 6-8 illustrate the interlocking tile system 115 having one or more anti-theft apparatus 100 engaged therewith. In the figures, portions of two tiles 120 and 130 are shown for the purpose of illustrating the interlocking nature of the tiles 120 and 130. However, it will be understood that each tile 120 and 130 is substantially identical, and any numbers of tiles 120 and 130 can be combined together to form a tile system in the manner described herein.

As best seen in FIG. 6, the anti-theft apparatus is inserted into the space 140 from the bottom side B of the tiles 120 and 130 such that the flange 102 extends over a top edge of the wall 126 of the female locking mechanism 122. In embodiments, the anti-theft apparatus 100 may be inserted such that the flange 102 extends over a top edge of the wall 124 of the female locking mechanism 122. In either event, the flange 104 may engage with an opposing bottom edge of the wall 126 (or wall 124) in an area 142 between the tiles 120 and 130. When the anti-theft apparatus 100 is engaged with the interlocked tiles 120 and 130, one of the spaces 140 previously open between the female interlocking mechanism 122 and the male interlocking mechanism 132 is almost entirely eliminated, as shown in FIG. 7, thereby making it nearly impossible to separate the tiles 120 and 130 without first removing the anti-theft apparatus 100.

Because the anti-theft apparatus 100 is inserted from the bottom side B of the tiles 120 and 130, when the tiles 120 and 130 are turned right-side-up (e.g., in an installed configuration), the anti-theft apparatus 100 is not accessible. Accordingly, a system of tiles incorporating the anti-theft apparatus 100 as described herein will be safeguarded from thieves.

It shall be understood that anti-theft apparatus can be incorporated into any interlocking tile system, regardless of the configuration of the interlocking mechanisms. In other words, while the anti-theft apparatus 100 is specifically described herein as engaging with interlocking mechanisms 122 and 132, anti-theft apparatus may engage with any configuration of interlocking mechanisms whether now known or later developed for the purpose of preventing theft of the respective tiles in a tile system. Exemplary interlocking mechanisms include but are not limited to tongue-and-groove systems, snap systems, et cetera.

Figure 9:
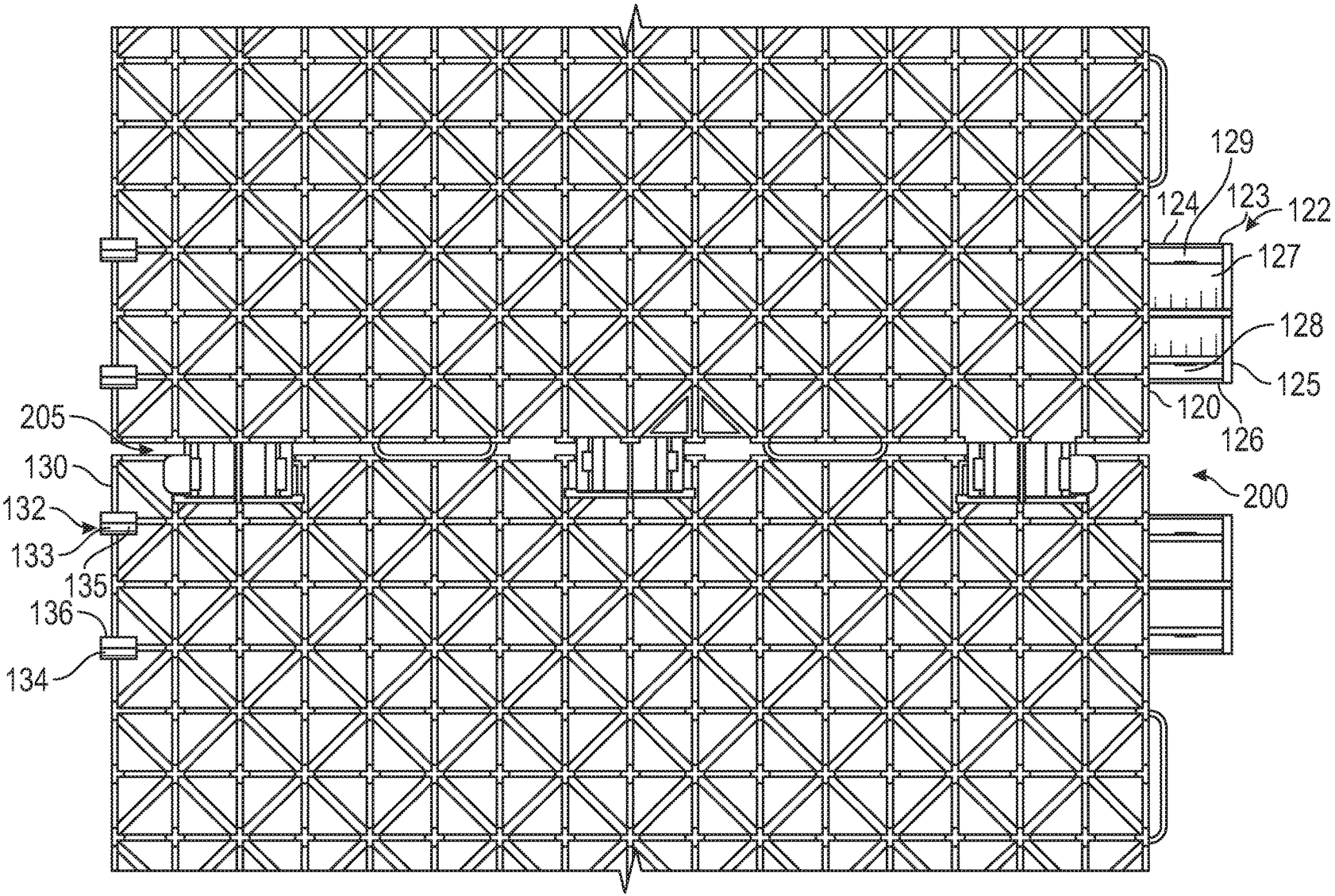
FIG. 9 is bottom view of the point of connection of the interlocking tile system of FIG. 4.

In most situations, many tiles 120 and 130 are interlocked together to form a tile surface, for example, a tennis court or a basketball court. In embodiments, a system of tiles 120 and 130 includes a plurality of anti-theft apparatus 100. More specifically, in some embodiments, at least one anti-theft apparatus 100 may be provided at each region of interlock 200 between two tiles (e.g., tiles 120 and 130) (i.e., the respective sides of the tiles where the two respective tiles meet) as shown in FIG. 9. For example, assume a tile system has 15 tiles per row running lengthwise, and 10 tiles per row running widthwise. One or more anti-theft apparatus 100 may be included at each region of interlock 200 (i.e., the respective sides of the tiles where two respective tiles mate). For a row of 15 tiles, there are accordingly 14 regions of interlock 200; for a row of 10 tiles, there are 9 regions of interlock 200. In embodiments, anti-theft apparatus 100 may be provided for each region of interlock 200 running around an entire perimeter of a tile system 115. Continuing the example from above, for a tile system 115 that is 15×10 tiles, there are a total of 46 regions of interlock 200 around the perimeter.

As is described above, each tile (e.g., tile 120) may have three female interlock mechanisms 122 at each region of interlock 200, with each female interlock mechanism 122 configured to closely mate with three male interlock mechanisms 132 of a second tile (e.g., tile 130) to form three points of connection 205 (FIG. 9). An anti-theft apparatus 100 may be incorporated into each point of connection 205 between the tiles 120 and 130 around the perimeter of the tile system 115. Utilizing the example discussed above, for 46 regions of interlock, there are 138 points of connection 205, and therefore 138 anti-theft apparatus 100. Alternately, one anti-theft apparatus 100 may be incorporated per region of interlock 200 (for a total of 46 anti-theft apparatus according to the example). In a preferred embodiment, two anti-theft apparatus 100 may be included at each region of interlock 200 around the perimeter of a tile system 115, for example, at the respective outer points of connection 205 of each region of interlock. For a 15×10 tile system, there are therefore 92 anti-theft apparatus 100. Optionally, additional anti-theft apparatus 100 may be incorporated into regions of interlock 200 between the tiles forming the perimeter of the tile system 115 and the tiles directly inward of the perimeter. Including anti-theft apparatus 100 in the regions of interlock between the tiles forming the perimeter and the tiles directly inward of the perimeter may further prevent the perimeter tiles from being disassembled from the rest of the tile system 115 (therefore preventing further disassembly of the tile system 115).

To remove the anti-theft apparatus 100 from the bottom of the conjoined tiles 120 and 130, a user may engage with the first flange 102 and dislodge the second flange 106 from the its engagement with the female interlock mechanism 122 by forcing the anti-theft apparatus 100 upward (i.e., in the direction of the top of the tile). The user may then pull the anti-theft apparatus 100 from the point of connection 205 via the flange 102. Once all anti-theft apparatus 100 are removed from a tile's regions of interlock 200, the respective tiles (e.g., tiles 120 and 130) can be separated by disconnecting the male interlock mechanism 132 from the female interlock mechanism 122 as described herein.

Many different arrangements of the described invention are possible without departing from the spirit and scope of the present invention. Embodiments of the present invention are described herein with the intent to be illustrative rather than restrictive. Alternative embodiments will become apparent to those skilled in the art that do not depart from its scope. A skilled artisan may develop alternative means of implementing the disclosed improvements without departing from the scope of the present invention.

Further, it will be understood that certain features and subcombinations are of utility and may be employed without reference to other features and subcombinations and are contemplated within the scope of the claims. Not all steps listed in the various figures and description need to be carried out in the specific order described. The description should not be restricted to the specific described embodiments.

What is claimed is:

1. An anti-theft tile system, comprising:

a first tile having a female interlock mechanism, the female interlock mechanism comprising a rectangular structure comprising a frame having three walls, a central portion defined within the frame, and two openings at opposing sides of the central portion between the central portion and the frame;

a second tile having a male interlock mechanism, the male interlock mechanism comprising a pair of spatially separated spring latches; each spring latch of the pair of spatially separated spring latches being respectively received into one of the two openings in the female interlock mechanism to secure the first tile to the second tile; and an anti-theft apparatus;

wherein:

in the secured position, a space is defined between each respective spring latch and the frame of the female interlock mechanism; and the anti-theft apparatus is inserted into one of the spaces between one of the respective spring latches and the frame of the female interlock mechanism.

2. The system of claim 1, wherein the anti-theft apparatus comprises a first flange extending perpendicularly from a first end of a support.

3. The system of claim 2, wherein the anti-theft apparatus comprises a second flange extending perpendicularly from a second end of the support.

4. The system of claim 3, wherein the first flange is longer than the second flange.

5. The system of claim 4, wherein the first flange is at least 50% longer than the second flange.

6. The system of claim 1, wherein the anti-theft apparatus comprises a first flange extending perpendicularly from a first end of a support, and wherein the first flange rests against and extends outwardly beyond the rectangular structure of the female interlock mechanism at a bottom edge thereof.

7. The system of claim 6, wherein the anti-theft apparatus further comprises a second flange extending perpendicularly from a second end of the support, and wherein the second flange rests against the rectangular structure of the female interlock mechanism at a top edge thereof.

8. The system of claim 1, wherein the female interlock mechanism comprises two female interlock mechanisms, and the male interlock mechanism comprises two male interlock mechanisms, each female interlock mechanism being configured to engage with a respective male interlock mechanism to form a respective point of connection.

9. The system of claim 8, wherein the anti-theft apparatus comprises two anti-theft apparatus, and wherein a respective anti-theft apparatus engages with each point of connection.

10. An anti-theft tile system, comprising:

a first tile having a plurality of female interlock mechanisms, each female interlock mechanism comprising a rectangular structure comprising a frame having three walls, a central portion defined within the frame, and two openings at opposing sides of the central portion between the central portion and the frame;

a second tile having a plurality of male interlock mechanisms, each male interlock mechanism comprising a pair of spatially separated spring latches; and a plurality of anti-theft apparatus;

wherein:

each spring latch of each pair of spatially separated spring latches is respectively received into one of the two openings in the respective female interlock mechanism to form a point of connection for securing the first tile to the second tile; and in the secured position, a space is defined between each respective spring latch and the frame of the respective female interlock mechanism; and one of the plurality of anti-theft apparatus is inserted into one of the spaces between one of the respective spring latches and the frame of the respective female interlock mechanism for at least two points of connection between the first and second tile.

11. The tile system of claim 10, wherein the anti-theft apparatus comprises a first flange extending from a first end of a support; and a second flange extending from a second end of the support.

12. The system of claim 10, wherein the first flange of each of the plurality of anti-theft apparatus engaged with a respective point of connection rests adjacent and extends outwardly beyond the rectangular structure of the respective female interlock mechanism at a bottom edge thereof.

13. The system of claim 12, wherein the second flange of each of the plurality of anti-theft apparatus engaged with a respective point of connection rests adjacent the rectangular structure of the respective female interlock mechanism at a top edge thereof.

* * * * *